United States Patent [19]

Rajakovics

[11] 4,041,709

[45] Aug. 16, 1977

[54] THERMAL POWER PLANTS AND METHOD OF OPERATING A THERMAL POWER PLANT

[75] Inventor: Gundolf E. Rajakovics, Vienna, Austria

[73] Assignee: Vereinigte Edelstahlwerke Aktiengesellschaft, Vienna, Austria

[21] Appl. No.: 654,961

[22] Filed: Feb. 3, 1976

Related U.S. Application Data

[63] Continuation of Ser. No. 480,898, June 19, 1974, abandoned.

[30] Foreign Application Priority Data

June 22, 1973 Germany ..... 2331741
Feb. 27, 1974 Austria ..... 1623/74

[51] Int. Cl.[2] ..... F01K 23/04
[52] U.S. Cl. ..... 60/655; 60/671
[58] Field of Search ..... 60/655

[56] References Cited

U.S. PATENT DOCUMENTS 3,095,698 7/1963 Stern ..... 60/644 X
3,195,304 7/1965 Stern et al. ..... 60/649
3,218,802 11/1965 Sawle ..... 60/655 X
3,234,734 2/1966 Buss et al. ..... 60/651

FOREIGN PATENT DOCUMENTS 1,204,119 12/1967 United Kingdom ..... 60/655

*Primary Examiner*—Allen M. Ostrager
*Attorney, Agent, or Firm*—Toren, McGeady and Stanger

[57] ABSTRACT

In the disclosed thermal power plant an alkali metal vapor energy conversion circuit is arranged in heat transfer relationship with an additional circuit whose working medium does not vigorously react with alkali metal. Diphenyl, terphenyl are disclosed as suitable media. The additional circuit may in turn be in heat transfer relationship with a steam circuit, in which event the additional circuit is interposed between the alkali metal energy conversion circuit and the water vapor (steam) circuit. The upper process temperature of the interposed energy conversion circuit is between about 420° and 480° C, preferably between 440° and 470° C. The transfer of the heat from the interposed circuit to the water vapor circuit preferably takes place in a temperature range in which the absorption by the water vapor circuit proceeds substantially isothermally.

4 Claims, 2 Drawing Figures

THERMAL POWER PLANTS AND METHOD OF OPERATING A THERMAL POWER PLANT

This is a continuation of application Ser. No. 480,898, filed on June 19, 1974, now abandoned.

FIELD OF INVENTION

The invention is directed to thermal power plants with a binary or ternary circuit system wherein an energy conversion circuit is either interposed between an alkali metal energy conversion circuit and a water vapor circuit or is in heat transfer relationship with the alkali metal vapor circuit without the provision of a steam circuit.

BACKGROUND INFORMATION AND PRIOR ART

The following relevant prior art literature is being referred to:

German Offenlegungsschrift No. 1,401,466

German Offenlegungsschrift No. 1,751,325

British Patent No. 687,896

British Patent No. 1,109,395

Nuclear Energy, January 1961, page 13.

English, R. E., and R. N. Weitmann: Experience in investigation of components of alkali-metal-vapor space power systems. "Alkali metal coolants", IAEA, Vienna 1966, P.711–725.

Rossbach, R. J. and G. M. Kaplan: Potassium testing of condensate removal devices for Rankine space power turbines. 6th IECEC (1971) No. 719059.

Bond, J. A., und M. U. Gutstein: Component and overall performance of an advanced Rankine cycle test rig. 6th IECEC (1971) No. 719064.

Frass, A. P.: A potassium-steam binary vapor cycle for better fuel economy and reduced thermal pollution. ASME-Winter Annual Meeting, Washington, December 1971, 71-WA/Ener-9.

Wilson, A. J.: Space power spinoff can add + 10 points of efficiency to fossil-fueled powder plants. 7th IECEC (1972) No. 729050.

Niggemann, R. G. 3000 hour endurance test of a 6 kWe organic Rankine cycle power system. 7th IECEC (1972). No. 729053.

In the construction of large thermal power plants the cost factor in respect of fuel, heat transfer and conversion and antipollution considerations for exhaust air and waste water has gained ever increasing importance. A solution of these problems is primarily contingent on and rendered possible by increasing the efficiency of the thermal power plant. An increase in the efficiency of the plant results at the same time in a lowering of the specific plant investment costs for all those structural elements which are primarily dependent on the thermal efficiency, for example the plant buildings, the heating surfaces, the condensers, the cooling water supply, the transport of fuel and the like. For this reason an increase in the efficiency of the plant is desirable from an economical point of view.

However, a substantial increase in the efficiency or output of a thermal power plant is only feasible from a practical point of view by using additional circuits, particularly alkali metal vapor circuits of high temperature which in certain instances may be combined with further circuits as, for example, a gas turbine circuit or process. For this reason it has recently and repeatedly been proposed to operate thermal power plants with such additional circuits.

In thermal power plants of the nature with which this invention is concerned, the heat which is generated as a result of a nuclear process or by combustion of fossil fuels, is utilized for the vaporization of alkali metals, particularly potassium. The potassium vapor which is thus formed is utilized in a potassium-steam turbine for recovery of mechanical energy and is subsequently condensed.

With a view to obtaining satisfactory total efficiency, the heat of the potassium energy conversion process has to be utilized for the recovery of further amounts of energy. Customarily this is achieved by utilizing the condensation heat of the potassium vapor for the vaporization of water into steam or for the superheating of steam. The steam thus formed is then subsequently utilized in customary manner in a steam turbine for energy recovery purposes and finally its condensation heat, in the form of lost heat, is discharged to the ambient atmosphere from a condenser. From a practical point of view, the vapor condensation stage of the alkali metal circuit and the steam generating stage are arranged in heat transfer relationship in a heat exchanger.

In respect to all those alkali metals which, from a practical point of view, can be considered for such procedures — potassium being the customary alkali metal for this purpose — the specific steam volume at temperatures below 450° C is already so large that economical use in temperature ranges below 450° C is hardly feasible. The lower process temperature of a potassium-steam circuit system is therefore customarily about 450° C or above.

If the potassium energy conversion circuit or process is coupled with a water (steam) energy conversion procedure in the above indicated manner, considerable difficulties are encountered inasmuch as the heat of the potassium vapor can be transferred to the steam loop under exceptionally large energy losses only. This is so because the major portion — particularly the portion that is attributed to the vaporization procedure proper — of the enthalpy increase in the steam circuit takes place at a level which is substantially below the condensation temperature of the potassium vapor. Further, in case of a defect in the potassium/water heat exchanger, water or steam of high pressure would enter the potassium vapor condensation space. This in turn, due to the pressure differential and also due to vigorous chemical reaction, would lead to very substantial damages and could even result in complete destruction of the heat exchanger. The occurrence of such a defect becomes the more likely the higher the pressure in the steam circuit, since the walls of the potassium/water heat exchanger, whose thickness of course increases with increasing pressure, are then subjected to higher thermal stresses, particularly during the starting and closing down stages so that an increased possibility for operational disturbances can be expected. On the other hand, the energy loss referred to above at the time of the heat transfer can only be decreased if extremely high pressures prevail in the steam circuit.

The construction of the potassium-water heat exchanger thus constitutes a major problem to avoid reaction between water and potassium in case of defect.

Further, as stated, high system pressures in the steam circuit cannot be avoided in view of the substantial differentials between potassium vapor condensation temperature and steam generating temperature. This problem cannot successfully be overcome by superheating of the steam.

SUMMARY OF THE INVENTION

It is an object of the invention to overcome the disadvantages and drawbacks referred to and to provide a thermal power plant of superior efficiency.

It is also an object of this invention to propose a method of operating a thermal power plant so as to increase its efficiency.

It is a further object of the invention to propose a thermal power plant which operates with an alkali metal circuit and which overcomes the difficulties previously encountered in the heat transfer from the alkali metal circuit to the steam circuit.

Briefly, and in accordance with one aspect of the invention and as applied to a thermal power plant with an alkali metal energy conversion circuit or loop — particularly a potassium vapor energy conversion loop — the condensation heat of the alkali metal vapor is transferred to an intermediate energy conversion cycle operating with an organic working medium, such as diphenyl or terphenyl, the upper process temperature of this intermediate energy conversion circuit being in the range of about 420° to 480° C, preferably 440° to 470° C, the heat of this intermediate energy conversion circuit being transferred to a conventional water (steam) energy conversion circuit at temperatures such that a substantially isothermal heat supply in the water vapor process is assured.

The various features of novelty which characterize the invention are pointed out with particularity in the claims annexed to and forming a part of this specification. For a better understanding of the invention, its operating advantages and specific objects attained by its use, reference should be had to the accompanying drawings and descriptive matter in which there are illustrated and described preferred embodiments of the invention.

Figure 1:
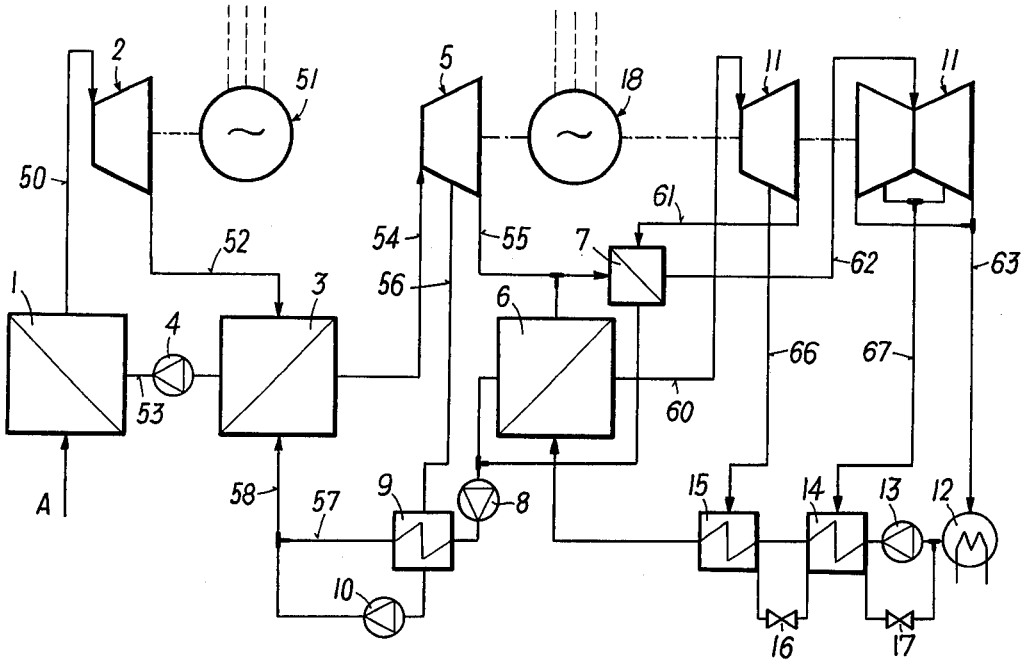
FIG. 1 is a diagrammatical representation of one embodiment of the inventive procedure.

Referring now to FIG. 1, reference numeral 1 indicates a suitable heat exchanger in which potassium or other suitable alkali metal - is vaporized by heat coming from a suitable source indicated by the arrow A. The potassium vapor thus formed is supplied to a turbine 2 through conduit 50. The useful energy obtained in the turbine 2 is transferred to the generator or another energy consumer as diagrammatically indicated in the drawing by reference numeral 51. The potassium vapor which exits from the turbine 2 flows through conduit 52 into the condenser or heat exchanger 3 where the potassium vapor is condensed. The condensed vapor is recycled to the heat exchanger through conduit 53, a feed pump 4 being provided in the line 53 for this purpose. A preheater (not shown) is preferably connected in the line 53 so that the condensed vapor is preheated before it again reaches the heat exchanger 1.

The condenser 3 has a second chamber in which an organic medium such as diphenyl or terphenyl is vaporized by the heat of the condensing potassium vapor. Condenser 3 thus is a heat exchanger and constitutes the vapor condensation stage of the primary alkali metal circuit and the vapor generating stage of the additional circuit. The vaporized organic medium flows through conduit 54 to the turbine 5. The diphenyl or terphenyl vapor exiting from turbine 5 is supplied through conduit 55 to the condensers 6 and 7, condenser 6 acting as the vapor condensation stage of the additional circuit and the steam generating stage of the steam circuit. Condenser 7 serves as intermediate superheater for the steam cycle. The condensed diphenyl or terphenyl vapor is recycled from the condenser 7 to the diphenyl evaporator (potassium vapor condenser) 3 by means of the feed pump 8 and through the preheater 9, the material flowing through conduit 57,58. Heat is supplied to the preheater 9 by means of bleeder steam taken from the turbine 5, the bleeder steam flowing through conduit 56. The condensate formed in this manner is supplied to the return line by means of the feed pump 10, as indicated by conduit 58.

Water is vaporized in the organic medium condenser 6 by the heat of the condensing medium. The steam thus generated is supplied to the high pressure portion of steam turbine 11, the steam flowing through conduit 60. The steam discharged from the turbine 11 flows through conduit 61 into the intermediate heater 7 and from there through conduit 62 into the double flow low pressure portion of the turbine 11. The steam exiting from the last two turbine stages is condensed in the condenser 12, the steam flowing through conduit 63. By means of feed pump 13 the condensed steam is supplied to the steam generator (organic medium condenser) 6 after having passed through two preheaters 14 and 15. The preheaters 14 and 15 are operated by means of bleeder steam from the high-pressure and low-pressure portion respectively of the turbine 11, the feed lines being indicated by conduits 66 and 67. The condensate which is formed in each instance is supplied to the feed pump 13 through reduction valves 16 and 17.

Both, the organic medium vapor turbine 5 and the steam turbine 11 drive generator 18 as indicated in the drawing.

Figure 2:
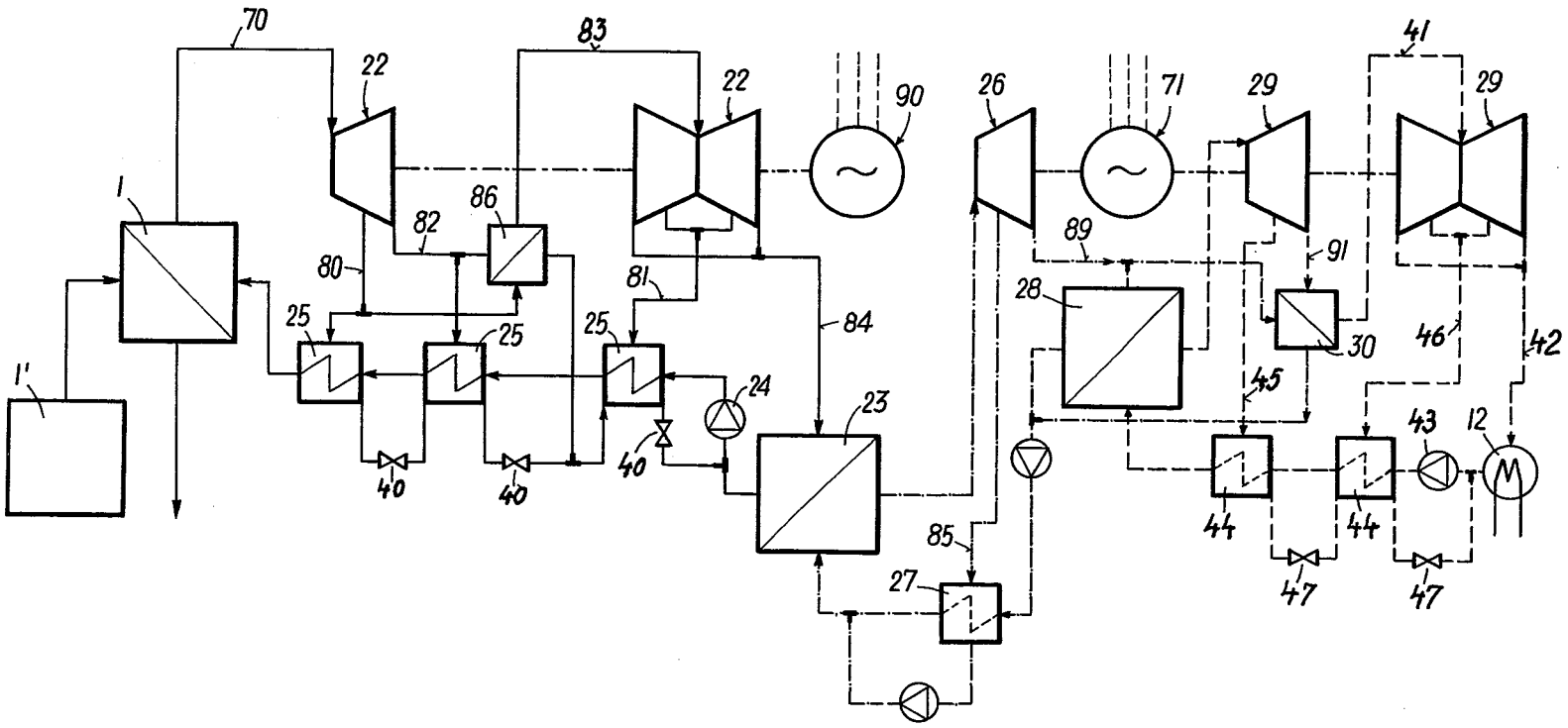
FIG. 2 is a diagrammatical representation of a second embodiment.

The embodiment of FIG. 2 refers to a thermal plant which is operated with fossil fuel. The combustion gases of the fossil fuel burner flow from the combustion chamber 1' into a heat exchanger 1 which contains potassium or the like suitable alkali metal. Potassium vapor of a temperature of 890° at a system pressure of 3 bar is produced in the heat exchanger 1 by heat transfer from the combustion gases. The heat exchanger 1 thus is at the same time a potassium vapor generator. The potassium vapor flows through line 70 into a multi-stage turbine 22 in which the potassium vapor is expanded to about 0.02 bar at 460° C. The turbine is operatively connected by generator 90. Potassium vapor exiting from the high-temperature part of the potassium vapor turbine 22 flows through line 82 into heat exchanger 86, where it is dried, subsequently flowing through line 83 to the low-temperature part of said potassium vapor turbine 22. The heat necessary for drying the potassium vapor in heat exchanger 86 is taken from condensing bleeder potassium vapor, the latter flowing through conduit 80 to the second side of heat exchanger 86. The potassium vapor leaving the low-temperature part of said potassium vapor turbine 22 flows through conduit 84 to heat exchanger 23, where it is condensed. Condensed potassium is recycled by means of feed pump 24 through potassium preheaters 25 to heat exchanger — potassium evaporator 1. Preheaters 25 are supplied with heat bleeder-potassium-vapor taken from said turbine 22, through conduits 80, 81, and 82. The preheating bleeder-vapor is condensed at the second side of preheaters 25 and then recycled to the main potassium passing throttle valves 40. The condensed bleeder vapor exiting heat exchanger 86 is also recycled to the main potassium stream in a similar manner. Mechanical energy recovered in the high-temperature and low-temperature parts of said potassium vapor turbine 22 is transferred to generator 90.

An intermediate circuit of a working medium that does not vigorously react with potassium or the like alkali metal and water is arranged in heat-exchange contact with the primary potassium vapor circuit. This circuit takes its heat from the condensation of the potassium vapor in heat exchanger 23 which at the same time thus acts as a vapor generator for the non-reacting medium of the additional or interposed circuit. In the present embodiment diphenyl is used as the medium of the interposed circuit. The heat exchanger 23 thus contains diphenyl which is vaporized by the condensation heat of condensing potassium vapor, diphenyl vapor of a temperature of 440° C and 18 bar being generated. This diphenyl vapor flows into a multi-stage turbine 26. It will be noted that the bleeder vapor is withdrawn from the turbine 26 through line 85 for preheating of the diphenyl in a preheater 27. The diphenyl vapor is utilized for the recovery of mechanical energy as diagrammatically indicated by reference numeral 71 which indicates a generator or the like. The diphenyl vapor is ultimately condensed in the heat exchanger 28 at a temperature of 290° C and at 2 bar. The heat exchanger 28 contains water which thus is vaporized by the condensation heat of the diphenyl vapor to generate steam of a temperature of 275° C and 60 bar, heat exchanger 28 thus serving as condensation stage for the interposed diphenyl circuit and as steam generating stage for the steam circuit. This steam is conducted in a conventional manner to a multi-stage steam turbine 29 with intermediate superheating in a superheater 30 the steam reentering the steam turbine at 10 bar and at a temperature of about 270° C. The turbine 29 is also connected to generator 71. The superheating of the steam is effected by condensing diphenyl vapor, the latter flowing through conduit 89 to the heat exchanger 30 and then being recycled to the main stream of diphenyl coming from condenser 28. Wet steam leaving the high-pressure part of steam turbine 29 flows through conduit 91 to heat exchanger 30 and then through line 11 to the low-pressure part of turbine 29 where it is expanded to 0.05 bar and to a temperature of 33° C. The steam exiting the low-pressure part of turbine 29 flows through line 42 to condenser 12 where it is condensed. The condensate is recycled by means of pump 43 passing the preheaters 44 to heat exchanger 28. Preheaters 44 are heated by bleeder steam coming through lines 45 and 46 from steam turbine 29. The bleeder steam condenses in the preheaters 44, the bleeder condensate is recycled to the main condensate stream passing throttle valves 47.

The condensation heat is dissipated in customary manner by means of fresh water cooling in the condenser 12. The procedure here described and illustrated has an actual efficiency of about 60 percent. In the absence of the interposed diphenyl circuit, the thermal power plant would have a circuit efficiency of about 50 percent only. Further, by interpositioning the diphenyl or the like circuit, the safety of the power plant is significantly increased since in the case of a defect the diphenyl does not vigorously react with either the alkali metal vapor or the water (steam). The probability that a defect may actually occur is much smaller in case of interpositioning the diphenyl circuit than without since the pressure acting inside the diphenyl circuit is only about 20 bar (in comparison to about 200 bar and more in case of a water steam circuit) and so the thicknesses of the wall of the heat exchanger tubes as well as of the tube plates, shells etc. are small and consequently, thermal stresses in these walls are low and much less than in those of the corresponding parts of a potassium vapor condenser cooled with water and steam of very high pressure in case of direct coupling with the potassium vapor energy conversion cycle with the (water) steam energy conversion cycle.

If in the above example the steam would be expanded to about 1 bar and 100° C in order to utilize the condensation heat for heating purposes or to dissipate the heat in a dry cooling tower in economical manner the efficiency of the procedure would decrease to about 55 percent which is still of economic interest. This means that the expansion of the steam does not occur below atmospheric pressure so that the steam which flows from the turbine still has a temperature of about 100° C. This steam should no longer be used for energy recovery. For this reason the steam may be used directly either for heating or other industrial purposes. The steam, however, could also be condensed in dry cooling towers. This has the advantage that lesser amounts of cooling water are required or air could be used as coolant. In this manner the thermal power plant would have a lesser polluting effect on the ambient atmosphere..

It should be noted that the organic media here disclosed, to wit diphenyl and terphenyl are not present in pure state at the relevant temperatures. A certain thermal decomposition takes place. However, the thermal decomposition at the relevant temperatures is insignificant so that the decomposition products can be readily removed by filtration or the like from the circulating medium.

It will be appreciated from the above that the invention successfully overcomes the difficulties of the prior art procedures referred to by arranging the additional circuit to which the heat from the alkali metal energy conversion process is transferred, this additional circuit operating with a working medium which does not vigorously react with alkali metal. If the thermal power plant comprises a third circuit, to wit, a steam producing circuit as disclosed in the above two embodiments, which is, considered from a thermal point of view, arranged beyond the alkali metal energy conversion circuit, the additional circuit is interposed between the alkali metal energy conversion circuit and the steam circuit, the medium of the interpositioned circuit then also being substantially nonreactive with water or steam. Suitable media for this purpose are organic substances such as the disclosed diphenyl or terphenyl.

In some instances it may prove advantageous to utilize some of the heat generated in the additional circuit for energy recovery purposes. This also holds true if the heat of the additional circuit is partially transferred to the steam-producing circuit.

The interpositioning of a third circuit as heat carrier between the alkali metal energy conversion circuit and the steam circuit results in an exceedingly high plant efficiency. This in turn makes it possible to raise the lower process temperature of the steam circuit to such an extent that heat generated by the steam circuit can be transferred or dissipated in economical manner in cooling towers, particularly in dry cooling towers, to air; or heat may be used for other heating purposes without causing a decrease in the plant efficiency to an extent which would make the operation of the plant uneconomical.

It will be appreciated that in certain instances it may be economical to operate the plant without a steam circuit and to utilize and/or convert directly the heat of the additional energy conversion circuit, to wit the diphenyl or terphenyl circuit which take its heat from the alkali metal circuits.

I claim:

1. A ternary power plant comprising a primary alkali metal energy conversion circuit utilizing an alkali metal as its working medium, a steam energy conversion circuit utilizing water as its working medium, an intermediate energy conversion circuit operatively interposed between said alkali metal circuit and said steam circuit, said intermediate circuit having as its working medium an organic substance which is incapable of vigorously reacting with either said alkali metal or water and is operating between an upper operating temperature and a condensing temperature, first heat transfer means interposed between said alkali metal circuit and said intermediate circuit to effect heat transfer between the working media thereof, and second heat transfer means interposed between said intermediate circuit and said steam circuit to effect heat transfer between the working media thereof, the upper operating temperature of said working medium of said intermediate circuit being within the range between about 420° and 480° C.

2. A power plant according to claim 1, wherein said range is between about 440° and 470° C.

3. A power plant according to claim 1, wherein said organic working medium of said intermediate circuit is diphenyl.

4. A power plant according to claim 1, wherein said second heat transfer means operates to effect heat transfer from said organic working medium of said intermedite circuit to said working medium of said steam circuit at such temperatures that the heat absorption of said working medium of said steam circuit takes place substantially isothermally.

* * * * *

UNITED STATES PATENT OFFICE

CERTIFICATE OF CORRECTION

Patent No. 4,041,709 Dated August 16, 1977

Inventor(s) Gundolf E. Rajakovics

It is certified that error appears in the above-identified patent and that said Letters Patent are hereby corrected as shown below:

In the heading of the patent [73] should read as follows:

--[73] Assignee: Vereinigte Edestahlwerke Aktiengesellschaft (VEW)--.

Signed and Sealed this

*Eighth* Day of *November 1977*

[SEAL]

*Attest:*

RUTH C. MASON
*Attesting Officer*

LUTRELLE F. PARKER
*Acting Commissioner of Patents and Trademarks*